US006384796B1

(12) United States Patent
Reimann et al.

(10) Patent No.: US 6,384,796 B1
(45) Date of Patent: May 7, 2002

(54) ANTENNA FOR RADIATING AND RECEIVING ELECTROMAGNETIC WAVES

(75) Inventors: Karl-Heinz Reimann, Langenhagen; Michael Kammer, Bad Nenndorf, both of (DE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/736,296

(22) Filed: Dec. 15, 2000

(30) Foreign Application Priority Data

Dec. 18, 1999 (DE) ..... 199 61 237

(51) Int. Cl.[7] ..... H01Q 13/00
(52) U.S. Cl. ..... 343/786; 343/756; 343/840
(58) Field of Search ..... 343/756, 772, 343/781 R, 786, 840; 333/126, 135

(56) References Cited

U.S. PATENT DOCUMENTS

| | | | | |
|---|---|---|---|---|
| 4,920,351 A | * | 4/1990 | Bartlett et al. | 343/756 |
| 5,216,433 A | | 6/1993 | Kurtz et al. | 343/786 |
| 5,258,768 A | | 11/1993 | Smith | 343/786 |
| 5,276,456 A | | 1/1994 | Kim | 343/786 |
| 5,784,033 A | | 7/1998 | Boldissar, Jr. | 343/786 |
| 5,923,229 A | * | 7/1999 | Simons | 333/135 |
| 6,060,961 A | * | 5/2000 | Moheb et al. | 333/126 |
| 6,130,649 A | * | 10/2000 | Wojtkowiak et al. | 343/786 |

FOREIGN PATENT DOCUMENTS

| | | | |
|---|---|---|---|
| DE | 34 39 413 A1 | 4/1986 | H01Q/13/06 |
| DE | 34 39 414 A1 | 4/1986 | H01Q/13/06 |
| DE | 34 39 416 A1 | 4/1986 | H01Q/13/06 |
| DE | 36 34 772 A1 | 3/1988 | H01Q/5/00 |
| DE | 44 25 048 A1 | 1/1996 | H01P/1/161 |
| DE | 197 25 047 A1 | 1/1998 | H01Q/19/02 |
| DE | 197 41 999 A1 | 3/1999 | H01P/1/161 |
| GB | 2 117 980 A | 10/1983 | H01P/1/161 |

* cited by examiner

*Primary Examiner*—Don Wong
*Assistant Examiner*—Hoang Nguyen
(74) *Attorney, Agent, or Firm*—Sughrue Mion, PLLC

(57) ABSTRACT

An antenna intended for radiating and receiving electromagnetic waves and including a parabolic reflector and an exciter, which is designed as a sub-reflector and which is attached in the focal point of the reflector at the end of a waveguide, guided through the center of the reflector. On the backside of the reflector a radio box, containing electric and electronic components, is attached to the waveguide, which is connected to a transmitter-receiver. To increase the transmission capacity, a polarization diplexer is provided between the radio box and the waveguide for simultaneous transmission of two orthogonal, linearly polarized waves. The diplexer has first and second inputs with an essentially rectangular clear cross section and an output, which can be attached to the waveguide. In the polarization diplexer there are two waveguide segments, one of which runs linearly between the first input and the output of the polarization diplexer, whereas the other, starting as a 90°0 curve at the second input of the polarization diplexer, empties into the linear waveguide segment in the course of the linear waveguide segment. The linear waveguide segment is rotated by 90° in the input area so that the large axes of the two inputs of the polarization diplexer that lie in the same plane are at right angles to each other.

5 Claims, 2 Drawing Sheets

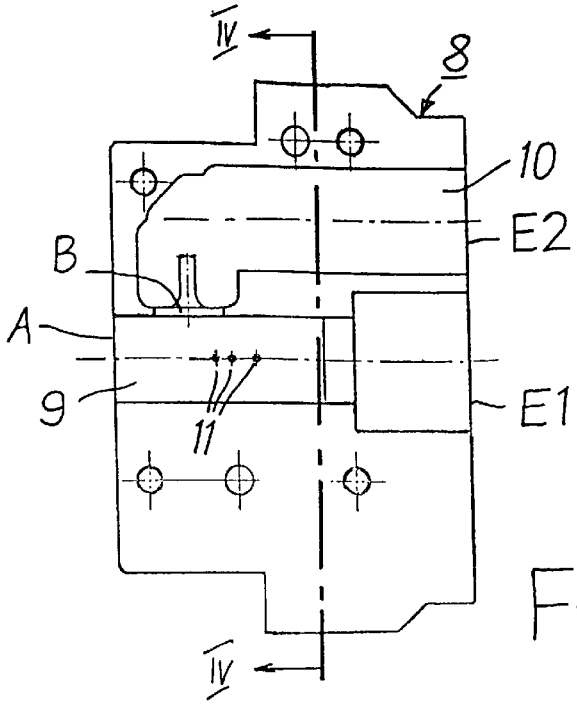
Fig. 3
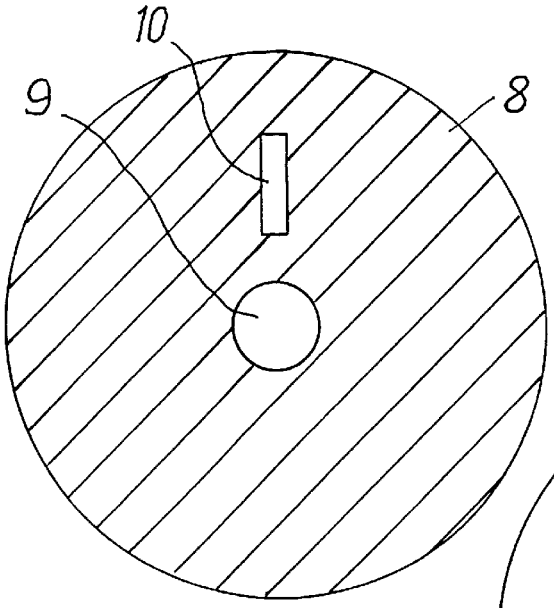
Fig. 4
Fig. 5
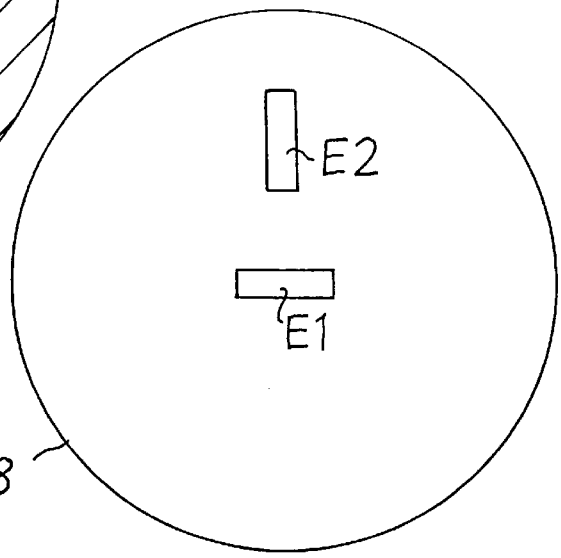

ANTENNA FOR RADIATING AND RECEIVING ELECTROMAGNETIC WAVES

BACKGROUND OF THE INVENTION

This application is based on and claims the benefit of German Patent Application No. 19961237.4 filed Dec. 18, 1999, which is incorporated by reference herein.

The invention relates to an antenna for radiating and receiving electromagnetic waves. Such an antenna comprises a parabolic reflector, and an exciter which is designed as a sub-reflector and which is attached in the focal point of the reflector at the end of a waveguide, guided through the center of the reflector. On the backside of the reflector a radio box containing electric and electronic components is attached to the waveguide, which is connected to a transmitter-receiver, e.g., as disclosed in German published application DE 197 25 047 A1.

Such antennas are called "Cassegrain" antennas due to the sub-reflector. They are used, for example, for mobile radio applications. The construction of antennas, according to the aforementioned German published application DE 197 25 047 A1, is relatively simple, since the horn, serving as the "exciter," and the sub-reflector are carried by waveguides, attached in the center of the reflector. The waveguide projects beyond the reflector, and on the backside there is a radio box, which is attached to the waveguide. Starting from the radio box, a coaxial high frequency cable runs to a transmitter-receiver. The radio box accommodates the electric and electronic components and a transmission path for the electromagnetic waves. This prior art antenna is designed to transmit a linearly polarized wave of a frequency or a frequency band.

SUMMARY OF THE INVENTION

The invention is directed to the problem of improving the transmission capacity of such an antenna without significantly changing its construction.

The invention solves this problem by providing a polarization diplexer between the radio box and the waveguide for simultaneous transmission of two orthogonal, linearly polarized waves, the diplexer having first and second inputs with an essentially rectangular clear cross section and an output, which can be attached to the waveguide, and by providing the polarization diplexer with two waveguide segments, of which the one runs linearly between the first input and the output of the polarization diplexer, whereas the other, starting as a 90° curve at the second input of the polarization diplexer, empties into the linear waveguide segment in the course of the linear waveguide segment, with the linear waveguide segment being rotated by 90° in the input area so that the large axes of the two inputs of the polarization diplexer that lie in the same plane are at right angles to each other.

By incorporating the polarization diplexer, the antenna can be used to transmit two separate, electromagnetic waves without having to change its basic design. In this manner the transmission capacity of the antenna is doubled in a simple manner. At the same time the polarization diplexer, whose dimensions are small, can be provided in place of the conventional simple waveguide segment so that the radio box can remain unaltered, except for an adapted "internal life." Therefore, no modifications have to be made in order to install the radio box at the reflector of the antenna. Hence, the polarization diplexer replaces a waveguide segment, which was used in the past to connect to the waveguide of the antenna. The attachment of the radio box to the polarization diplexer is also very simple, since the two inputs of the same lie in one plane. The decoupling of the two linearly polarized waves is guaranteed in a simple manner in that the large axes of the two inputs of the polarization diplexer run at right angles to each other.

BRIEF DESCRIPTION OF THE DRAWINGS

One embodiment of the invention will be described with reference to the accompanying drawings, in which:

FIG. 3 is another enlarged view of a cross section of the polarization diplexer, belonging to the antenna;

FIG. 4 is a cross section of FIG. 3 along the line IV—IV; and

FIG. 5 is a side view of the polarization diplexer of FIG. 3.

DETAILED DESCRIPTION OF THE INVENTION

Figure 1:
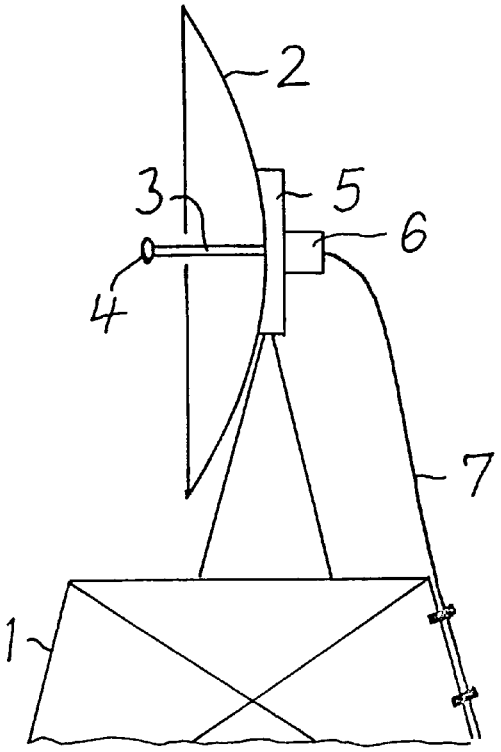
FIG. 1 is a schematic drawing of a system with an antenna, according to the invention.
Figure 2:
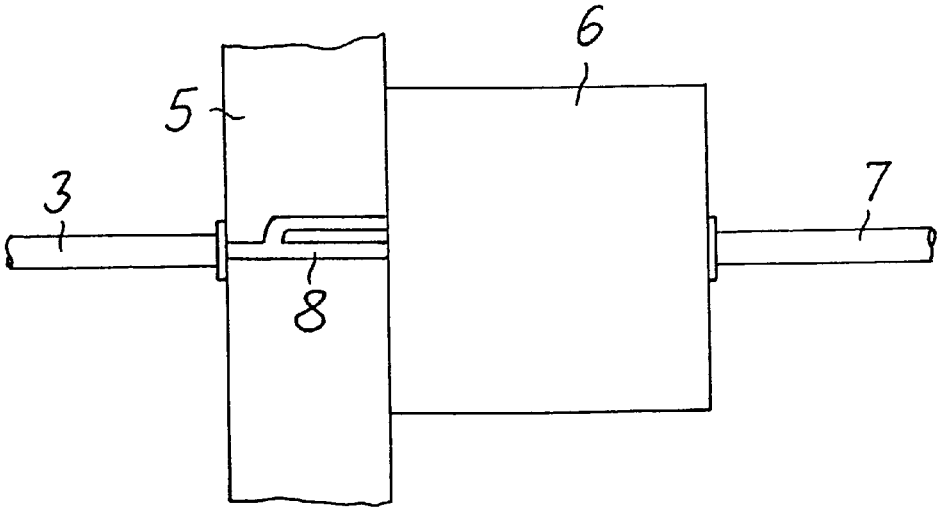
FIG. 2 is an enlarged view of a detail of FIG. 1.

A parabolic reflector 2 of an antenna for transmitting electromagnetic waves is mounted on a mast 1, of which only a portion is shown. In the center of the reflector 2 is attached an electromagnetic waveguide 3, to whose end is attached an exciter 4, designed as a sub-reflector, at the focal point of the antenna. The backside of the reflector 1 includes a fastening element 5, by means of which the reflector can be fastened to the mast 1. The fastening element 5 includes on its other side a radio box 6, which is connected, on the one hand, to the waveguide 3 and, on the other hand, to a coaxial cable 7, which runs to a transmitter-receiver (not illustrated) for transmitting high frequency signals. Instead of the coaxial cable 7, a waveguide could also be used.

The radio box 6 contains electric and electronic components, such as converters and other adapting elements. Between the radio box 6 and the waveguide 3 is a polarization diplexer 8, which is located inside the fastening element 5 and whose precise construction is shown in FIGS. 3–5.

The polarization diplexer 8 has two waveguide segments 9 and 10, of which the waveguide segment 9 is designed linearly and runs between a first input E1 of the polarization diplexer 8 and an output A of the same. The other waveguide segment 10 follows a path curved by 90°, starting at a second input E2 of the polarization diplexer 8 and feeding into the linear waveguide segment via an iris B in the side of the linear waveguide segment 9. Between the iris B and the first input E1 of the polarization diplexer 8, a short-circuit element 11 is mounted in linear waveguide segment 9, the short circuit element 11 in the illustrated embodiment comprising three pins. It is supposed to prevent the waves, which are to be fed by means of the waveguide segment 10 or fed into the same, from spreading in the wrong direction. The polarization diplexer 8 is attached with its output A to the waveguide 3.

In preferred embodiments the linear waveguide segment 9 has a circular clear cross section. However, it could also be square or have another appropriate clear cross section. For the waveguide segment 10 the preferred embodiment provides a rectangular clear cross section. However, it could also be elliptical or have another appropriate clear cross section. The clear cross sections of the two inputs E1 and E2 are essentially rectangular; their corners can be rounded. The short-circuit element 11 can also comprise a strip of sheet metal.

To decouple the two linearly polarized waves without any additional elements, the linear waveguide segment 9 is rotated by 90° in the area of its input E1. It can be implemented by a transition to a continuous or stepped design, as is typical in waveguide technology. According to FIG. 5, the large axes of both inputs E1 and E2 of the polarization diplexer 8 that lie in a common plane or the same plane are, consequently, orthogonal to each other. Thus, the radio box 6 with its continuing transmission paths can be attached directly to the polarization diplexer 8.

The polarization diplexer 8 is made expediently of two parts, which are to be connected together and into which are cut, e.g., by milling, a part of the waveguide segments 9 and 10.

What is claimed is:

1. An antenna for radiating and receiving electromagnetic waves and comprising a parabolic reflector, an exciter designed as a sub-reflector and attached at the focal point of the reflector at an end of a waveguide which is guided through a center of said reflector, and a radio box attached to said waveguide on a backside of the reflector, said antenna further comprising a polarization diplexer between the radio box and the waveguide for simultaneous transmission of two orthogonal, linearly polarized waves, said diplexer having first and second inputs with a substantially rectangular cross section, and an output which can be attached to the waveguide, said polarization diplexer including two waveguide segments, one of which is a linear waveguide segment running linearly between the first input and the output of the polarization diplexer, the other of which is a curved waveguide segment starting as a 90° curve at the second input of the polarization diplexer and feeding into the linear waveguide segment, and the linear waveguide segment being rotated by 90° in the input area so that the large axes of the two inputs of the polarization diplexer that lie in the same plane are at right angles to each other.

2. An antenna as claimed in claim 1, characterized in that the curved waveguide segment is attached by means of an iris to the linear waveguide segment.

3. An antenna as claimed in claim 1, characterized in that at least one short-circuit element is attached between an iris and the input of the linear waveguide segment.

4. An antenna as claimed in claim 1, characterized in that the curved waveguide segment has a rectangular cross section.

5. An antenna as claimed in claim 1, characterized in that the linear waveguide segment has a circular cross section.

* * * * *